US012692636B2

(12) United States Patent
Liao et al.

(10) Patent No.: US 12,692,636 B2
(45) Date of Patent: Jul. 28, 2026

(54) DECOLORIZATION METHOD OF POLYESTER FABRIC

(71) Applicant: NAN YA PLASTICS CORPORATION, Taipei (TW)

(72) Inventors: Te-Chao Liao, Taipei (TW); Jung-Jen Chuang, Taipei (TW); Zhang-Jian Huang, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 567 days.

(21) Appl. No.: 18/366,680

(22) Filed: Aug. 8, 2023

(65) Prior Publication Data

US 2025/0011991 A1 Jan. 9, 2025

(30) Foreign Application Priority Data

Jul. 7, 2023 (TW) ..... 112125566

(51) Int. Cl.

| | |
|---|---|
| ***D06B 9/02*** | (2006.01) |
| ***D06B 9/06*** | (2006.01) |
| ***D06L 4/70*** | (2017.01) |

(52) U.S. Cl.

CPC ..... *D06B 9/02* (2013.01); *D06B 9/06* (2013.01); *D06L 4/70* (2017.01)

(58) Field of Classification Search

CPC ... D06B 9/02; D06B 9/06; D06L 4/70; Y02W 30/62

See application file for complete search history.

(56) References Cited

U.S. PATENT DOCUMENTS

| | | | |
|---|---|---|---|
| 4,003,881 | A † | 1/1977 | Sidebotham |
| 4,867,789 | A † | 9/1989 | Eida |
| 7,959,807 | B2 † | 6/2011 | Mukai |
| 2022/0169786 | A1 † | 6/2022 | Takao |

FOREIGN PATENT DOCUMENTS

| | | |
|---|---|---|
| CN | 107587362 | 1/2018 |
| CN | 116289167 | 6/2023 |
| JP | 2023041605 | 3/2023 |

(Continued)

OTHER PUBLICATIONS

"Office Action of Japan Counterpart Application", issued on Nov. 27, 2024, p. 1-p. 3.

(Continued)

*Primary Examiner* — Angela C Brown-Pettigrew
*Assistant Examiner* — Preeti Kumar
(74) *Attorney, Agent, or Firm* — JCIPRNET

(57) ABSTRACT

A decolorization method of a polyester fabric, including the following steps, is provided. A first extraction treatment is performed on the polyester fabric using a recycled solvent, so that a first portion of a dye in the polyester fabric moves into the recycled solvent. A first filtering treatment is performed on the recycled solvent and the polyester fabric to obtain a treated polyester fabric. A second extraction treatment is performed on the treated polyester fabric using a fresh solvent, so that a second portion of the dye in the treated polyester fabric moves into the fresh solvent. A second filtering treatment is performed to obtain a decolored polyester fabric and the recycled solvent.

9 Claims, 1 Drawing Sheet

(56) References Cited

FOREIGN PATENT DOCUMENTS

| | | |
|---|---|---|
| JP | 2023063248 | 5/2023 |
| TW | I481762 | 4/2015 |
| TW | 202311395 | 3/2023 |
| TW | 202328314 | 7/2023 |
| WO | 2007018161 | 2/2007 |

OTHER PUBLICATIONS

English portions only. "Office Action of Taiwan Counterpart Application", issued on Dec. 18, 2023, p. 1-p. 6.

† cited by third party

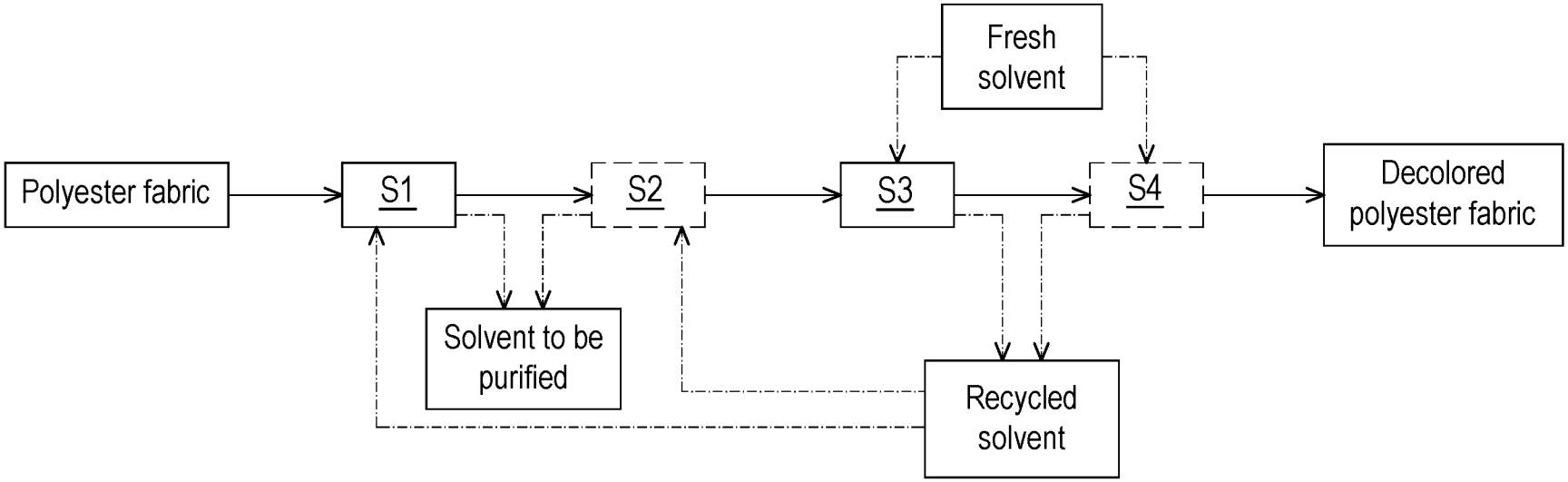
Polyester fabric
S1
S2
S3
S4
Fresh solvent
Solvent to be purified
Recycled solvent
Decolored polyester fabric

DECOLORIZATION METHOD OF POLYESTER FABRIC

CROSS-REFERENCE TO RELATED APPLICATION

This application claims the priority benefit of Taiwan application serial no. 112125566, filed on Jul. 7, 2023. The entirety of the above-mentioned patent application is hereby incorporated by reference herein and made a part of this specification.

BACKGROUND

Technical Field

The disclosure relates to a decolorization method of a fabric, and in particular to a decolorization method of a polyester fabric.

Description of Related Art

Polyester fabrics (for example, polyethylene terephthalate (PET) fabrics) often contain impurities such as dyes attached thereto. Generally speaking, the impurities such as dyes need to be first removed with a suitable solvent, and then the decolored polyester fabric can be effectively separated and purified, thereby recycling polyester and fiber materials in the polyester fabric.

Currently, during the process of removing the impurities such as dyes, 3 to 6 extractions need to be performed with a solvent/polyester fabric weight ratio of 5 to 10. In other words, the amount of solvent used may be as much as 15 to 60 times the weight of the fabric, such that there is a very large amount of solvent that needs to be purified before the solvent can be reused. In addition, the decolored polyester fabric obtained after the above extraction treatment still shows a color cast phenomenon. For example, a blue fabric still has a bluish color after decolorization, and so on.

U.S. Pat. No. 7,959,807 B2 proposes a method for removing a dye from a PET fabric. Although such method can remove the dye, the treated PET fabric also shows the color cast phenomenon, and the amount of solvent used is as much as 24 times the weight of the fabric. Therefore, the cost of solvent recycling is very high.

TW 1481762B proposes a method for removing a dye from a PET recycled cloth, and such method is to extract the dye using a solvent evaporation gas. Although the efficiency of the extraction of the dye can be improved, there is still the color cast phenomenon, and the extraction of the dye with solvent vapor causes the cost of energy consumption to be too high.

SUMMARY

The disclosure provides a decolorization method of a polyester fabric, which has low solvent usage and stable fabric color after decolorization, can reduce the decolorization cost of the polyester fabric, and can lighten a color cast phenomenon.

A decolorization method of a polyester fabric of the disclosure includes the following steps. A first extraction treatment is performed on the polyester fabric using a recycled solvent, so that a first portion of a dye in the polyester fabric moves into the recycled solvent. A first filtering treatment is performed on the recycled solvent and the polyester fabric to obtain a treated polyester fabric. A second extraction treatment is performed on the treated polyester fabric using a fresh solvent, so that a second portion of the dye in the treated polyester fabric moves into the fresh solvent. A second filtering treatment is performed to obtain a decolored polyester fabric and the recycled solvent.

In an embodiment of the disclosure, the recycled solvent includes the fresh solvent and the dye, and based on a total weight of the recycled solvent, the dye is 0.1 wt % to 10 wt %.

In an embodiment of the disclosure, in the first extraction treatment, a weight ratio of the recycled solvent to the polyester fabric is 4:1 to 50:1.

In an embodiment of the disclosure, a weight ratio of the fresh solvent to the treated polyester fabric is 4:1 to 50:1.

In an embodiment of the disclosure, the fresh solvent includes an aromatic hydrocarbon solvent, an alcohol ether solvent, a benzyl alcohol solvent, an alcohol solvent, or an amide solvent.

In an embodiment of the disclosure, the fresh solvent includes benzene, toluene, xylene, propylene glycol monomethyl ether, ethylene glycol monobutyl ether, diethylene glycol monobutyl ether, butanol, pentanol, hexanol, dimethylformamide, dimethylacetamide, or a combination thereof.

In an embodiment of the disclosure, based on a total weight of the dye, a total amount of the first portion and the second portion removed is 90 wt % to 99.9 wt %.

In an embodiment of the disclosure, a CIELAB color definition of the decolored polyester fabric has L value of above 80, a value of −3.0 to +3.0, and b value of −6.0 to +6.0.

In an embodiment of the disclosure, the decolorization method further includes repeatedly performing a cycle of the first extraction treatment and the first filtering treatment 1 to 7 times before the second extraction treatment.

In an embodiment of the disclosure, the decolorization method further includes repeatedly performing a cycle of the second extraction treatment and the second filtering treatment 1 to 3 times after the second filtering treatment.

Based on the above, in the decolorization method of the polyester fabric of the disclosure, performing the former extraction treatment on the polyester fabric using the recycled solvent can lighten the color cast phenomenon in the decolored polyester fabric produced. At the same time, the amount of the fresh solvent used and the amount of the recycled solvent produced can be greatly reduced, thereby reducing the cost required for performing the decolorization treatment on the polyester fabric.

BRIEF DESCRIPTION OF THE DRAWINGS

FIGURE is a schematic flow chart of a decolorization method of a polyester fabric according to an embodiment of the disclosure.

DESCRIPTION OF THE EMBODIMENTS

Hereinafter, embodiments of the disclosure will be described in detail. However, the embodiments are illustrative, and the disclosure is not limited thereto.

Herein, a range indicated by "a value to another value" is a general representation which prevents listing all values in the range one-by-one in the specification. Therefore, the recitation of a specific value range covers any value in the value range and a smaller value range defined by any value in the value range, as if the arbitrary value and the smaller value range are written in the specification.

FIGURE is a schematic flow chart of a decolorization method of a polyester fabric according to an embodiment of the disclosure.

Please refer to FIGURE. In Step S1, first, a first extraction treatment is performed on the polyester fabric using a recycled solvent, so that a first portion of a dye in the polyester fabric moves into the recycled solvent.

In some embodiments, the recycled solvent includes a fresh solvent and the dye, and based on the total weight of the recycled solvent, the dye is 0.1 wt % to 10 wt %, such as 2 wt %, 6 wt %, or 8 wt %. For example, the recycled solvent may be a dye-containing solvent produced after performing an extraction treatment and a filtering treatment on a polyester fabric or a treated polyester fabric using a fresh solvent. Since the recycled solvent has a lower dye concentration, the recycled solvent can also be used to perform the first extraction treatment on polyester fabrics of other batches.

In some embodiments, the polyester fabric includes a decolored polyester fabric and the dye, wherein the decolored polyester fabric may include polyester and fibers. In some embodiments, the polyester in the decolored polyester fabric is polyethylene terephthalate (PET). In some embodiments, the fibers in the decolored polyester fabric include cotton fibers. In some embodiments, based on the total weight of the polyester fabric as 100 parts by weight, the content of the dye in the polyester fabric is, for example, 0.1 parts by weight to 10 parts by weight, such as 3 parts by weight, 5 parts by weight, or 9 parts by weight. For example, the polyester fabric may be a product obtained by dyeing and finishing an undyed polyester fabric.

In some embodiments, the weight ratio of the recycled solvent to the polyester fabric for performing the first extraction treatment is 4:1 to 50:1. In certain embodiments, the weight ratio of the recycled solvent to the polyester fabric for performing the first extraction treatment is 5:1 to 20:1, such as 6:1, 10:1, or 15:1.

In some embodiments, the first extraction treatment includes placing the polyester fabric in the recycled solvent, and then heating the polyester fabric and the recycled solvent to a treatment temperature. In some embodiments, the treatment temperature of the first extraction treatment is higher than the glass transition temperature (Tg) of the polyester in the polyester fabric and is lower than the melting point of the polyester. In some embodiments, the treatment temperature of the first extraction treatment is 80° C. to 160° C. In some embodiments, the treatment temperature of the first extraction treatment is 100° C. to 150° C., such as 120° C., 130° C., or 140° C. In some embodiments, the treatment time of the first extraction treatment is 0.5 hours to 5 hours. In some embodiments, the treatment time of the first extraction treatment is 1 hour to 3 hours, such as 1.5 hours, 2 hours, or 2.5 hours. In some embodiments, the treatment pressure of the first extraction treatment is 1.0 bar to 2.0 bar. In certain embodiments, when the boiling point of the recycled solvent is lower than the glass transition temperature of the polyester in the polyester fabric, the treatment pressure of the first extraction treatment may be greater than 1.0 bar.

Then, a first filtering treatment is performed on the recycled solvent and the polyester fabric to obtain the treated polyester fabric and a filtered solvent to be purified, wherein the treated polyester fabric may include the decolored polyester fabric to be subsequently produced and remaining dye, and the remaining dye is a residual dye after the first portion of the dye is removed. In some embodiments, the first filtering treatment uses a sieve for filtration to separate the solvent to be purified from the treated polyester fabric. In some embodiments, the sieve has a pore size of 0.1 mm to 1.0 mm, such as 0.3 mm, 0.5 mm, or 0.7 mm. In some embodiments, after the first extraction treatment and before the first filtering treatment, a cooling treatment may be performed first. For example, the temperature is lowered to between 25° C. and 80° C., and then the treated polyester fabric and the solvent to be purified are separated.

In some embodiments, the solvent to be purified includes a pure solvent and the dye. The solvent to be purified may have a higher dye concentration, so the solvent to be purified is no longer suitable for performing the extraction treatment. In some embodiments, the dye concentration in the solvent to be purified is greater than the dye concentration in the recycled solvent. In some embodiments, based on the total weight of the solvent to be purified as 100 parts by weight, the content of the dye in the solvent to be purified is about 1.0 parts by weight to 30 parts by weight, such as 12 parts by weight, 18 parts by weight, or 24 parts by weight. In some embodiments, a distillation or evaporation treatment is performed on the solvent to be purified to purify the solvent in the solvent to be purified into a pure solvent. In some embodiments, the pure solvent may be used as the fresh solvent.

Please continue to refer to FIG. 1. In optional Step S2, Step S1 may be repeatedly performed m times. In other words, after Step S1 is completed, Step S2 may be skipped and Step S3 may be directly performed; or after Step S1 is completed, Step S1 may be repeatedly performed m times, and then Step S3 may be performed. In some embodiments, m may be 1 to 7, that is, Step S1 may be repeated 1 time, 2 times, 3 times, 4 times, 5 times, 6 times, or 7 times, but the disclosure is not limited thereto.

Next, in Step S3, a second extraction treatment may be performed on the treated polyester fabric using the fresh solvent first, so that a second portion of the dye in the treated polyester fabric moves into the fresh solvent. In some embodiments, the second extraction treatment includes placing the treated polyester fabric in the fresh solvent, and then heating the treated polyester fabric and the fresh solvent to a treatment temperature higher than the glass transition temperature of the polyester in the polyester fabric and lower than the melting point of the polyester.

In some embodiments, in the second extraction treatment, the weight ratio of the fresh solvent to the treated polyester fabric is 4:1 to 50:1. In certain embodiments, in the second extraction treatment, the weight ratio of the fresh solvent to the treated polyester fabric is 5:1 to 20:1. In some embodiments, the treatment temperature of the second extraction treatment is 80° C. to 160° C. In some embodiments, the treatment temperature of the second extraction treatment is 100° C. to 150° C. In some embodiments, the treatment time of the second extraction treatment is 0.5 to 5 hours. In some embodiments, the treatment time of the second extraction treatment is 1 to 3 hours.

In some embodiments, the fresh solvent includes an aromatic hydrocarbon solvent, an alcohol ether solvent, a benzyl alcohol solvent, an alcohol solvent, or an amide solvent. In some embodiments, the aromatic hydrocarbon solvent includes benzene, toluene, or xylene. In some embodiments, the alcohol ether solvent includes propylene glycol monomethyl ether, ethylene glycol monobutyl ether, or diethylene glycol monobutyl ether. In some embodiments, the alcohol solvent includes butanol, pentanol, or hexanol. In some embodiments, the amide solvent includes dimethylformamide or dimethylacetamide. In some embodiments, the fresh solvent includes benzene, toluene, xylene, propylene glycol monomethyl ether, ethylene glycol monobutyl ether, diethylene glycol monobutyl ether, butanol, pentanol, hexanol, dimethylformamide, dimethylacetamide, or a combination thereof.

Then, after the second extraction treatment, a second filtering treatment is performed to obtain the decolored polyester fabric and the recycled solvent, wherein the recycled solvent may be used to perform the first extraction treatment. In some embodiments, the decolored polyester fabric may include a trace amount of the dye, and the trace amount of the dye is a residual dye after removing the first portion and the second portion of the dye. In some embodiments, based on the total weight of the dye in the polyester fabric as 100 parts by weight, the total amount of the first portion removed through the first extraction treatment and the second portion removed through the second extraction treatment is, for example, 90 parts by weight to 99.9 parts by weight, such as 92 parts by weight, 95 parts by weight, or 98 parts by weight.

In some embodiments, the second filtering treatment uses a sieve for filtration to separate the recycled solvent from the decolored polyester fabric. In some embodiments, the sieve has a pore size of 0.1 mm to 1.0 mm, such as 0.3 mm, 0.5 mm, or 0.7 mm. In some embodiments, after the second extraction treatment, the decolored polyester fabric and the recycled solvent may be cooled first, for example, to a temperature of between 25° C. and 80° C., and then the second filtering treatment is performed.

Then, in optional Step S4, Step S3 may be repeatedly performed n times. In other words, after Step S3 is completed, Step S4 may be skipped; or after Step S3 is completed, Step S3 may be repeatedly performed n times. In some embodiments, n may be 1 to 3, that is, Step S3 may be repeated 1 time, 2 times, or 3 times, but the disclosure is not limited thereto.

In some embodiments, the decolorization method of the polyester fabric further includes performing a drying treatment on the decolored polyester fabric to remove a residual solvent on the decolored polyester fabric. For example, the decolored polyester fabric may be placed in an oven with a temperature set at 80° C. to 160° C., and left to stand for 1 hour to 24 hours for drying. In some embodiments, the decolored polyester fabric after the drying treatment is white and has a CIELAB color definition with L value of above 80, a value of −3.0 to +3.0, and b value of −6.0 to +6.0.

Hereinafter, the decolorization method of the polyester fabric proposed by the disclosure will be described in detail by means of examples. However, the following examples are not intended to limit the disclosure.

Example 1

Please refer to FIGURE at the same time. First, Step S1 was performed using a propylene glycol monomethyl ether recycled solvent and a PET fabric to obtain a treated PET fabric, wherein the weight ratio of the propylene glycol monomethyl ether recycled solvent to the PET fabric was 6:1, the treatment temperature of the first extraction treatment was 120° C., the treatment time of the first extraction treatment was 0.5 hours, the treatment pressure of the first extraction treatment was 1.0 bar, the first filtering treatment used a sieve with a pore size of 0.5 mm, the propylene glycol monomethyl ether recycled solvent contained about 0.5 wt % of dye, and the PET fabric contained about 8 wt % of dye.

Next, Step S1 was repeatedly performed 2 times in Step S2. Then, Step S3 was performed using a propylene glycol monomethyl ether fresh solvent and a treated PET fabric to produce a decolored PET fabric and the propylene glycol monomethyl ether recycled solvent, wherein the weight ratio of the propylene glycol monomethyl ether fresh solvent to the treated PET fabric was 6:1, the treatment temperature of the second extraction treatment was 120° C., the treatment time of the second extraction treatment was 0.5 hours, the treatment pressure of the second extraction treatment was 1.0 bar, and the second filtering treatment used a sieve with a pore size of 0.5 mm.

Next, Step S4 was skipped. Since the second extraction treatment was performed once in total, in Example 1, the total amount of the fresh solvent used was only about 6 times of the weight of the PET fabric. Therefore, the total amount of the propylene glycol monomethyl ether recycled solvent produced was about 6 times the weight of the PET fabric, which might be used as the recycled solvent for PET fabrics of other batches when performing the first extraction treatment of Step S1. In addition, since the first extraction treatment was performed three times in total, the amount of the recycled solvent that could be reused in Example 1 was as much as 18 times the weight of the PET fabric, which greatly improved the reuse rate of the recycled solvent, thereby reducing the amount of the solvent to be purified of the overall decolorization treatment procedure, so the purification energy consumption and the purification cost of the solvent could be reduced.

Next, the decolored polyester fabric obtained was dried in an oven at 105° C. for 2 hours for a drying treatment. Afterwards, the measured CIELAB color definition of the decolored polyester fabric had L value of 82, a value of 1.1, and b value of 2.4. The fabric color after decolorization was stable and the amount of color cast was reduced. The total amount of dye removed was about 99.4 wt %.

Example 2

The main differences between the treatment procedure of Example 2 and the treatment procedure of Example 1 were that Step S1 was repeatedly performed 1 time in Step S2; Step S3 was repeatedly performed 1 time in Step S4; the treatment temperature of the first extraction treatment and the second extraction treatment was 130° C.; and the treatment pressure of the first extraction treatment and the second extraction treatment was 1.8 bar.

Since the second extraction treatment was performed two times in total, in Example 2, the total amount of the fresh solvent used was about 12 times the weight of the PET fabric. Therefore, the total amount of the propylene glycol monomethyl ether recycled solvent produced was about 12 times the weight of the PET fabric, which might be used as the recycled solvent for PET fabrics of other batches when performing the first extraction treatment of Step S1. In addition, since the first extraction treatment was performed two times in total, the amount of the recycled solvent that could be reused in Example 2 was about 12 times the weight of the PET fabric, which could also improve the reuse rate of the recycled solvent, thereby reducing the amount of the solvent to be purified of the overall decolorization treatment procedure, so as to reduce the purification energy consumption and the purification cost of the solvent.

After performing a drying treatment on the decolored polyester fabric obtained, the measured CIELAB color definition of the decolored polyester fabric produced in Example 2 had L value of 83, a value of 1.8, and b value of 2.7. The fabric color after decolorization was stable, and the amount of color cast was reduced. The total amount of dye removed was about 99.6 wt %.

Example 3

The main differences between the treatment procedure of Example 3 and the treatment procedure of Example 1 were that Step S1 was repeatedly performed 1 time in Step S2; and Step S3 was repeatedly performed 1 time in Step S4.

Since the second extraction treatment was performed two times in total, in Example 3, the total amount of the fresh solvent used was about 12 times the weight of the PET fabric, so the weight of the propylene glycol monomethyl ether recycled solvent produced was about 12 times the weight of the PET fabric, which might be used as the recycled solvent for PET fabrics of other batches when performing the first extraction treatment of Step S1. In addition, since the first extraction treatment was performed two times in total, the amount of the recycled solvent that could be reused in Example 3 was about 12 times the weight of the PET fabric, which could also improve the reuse rate of the recycled solvent, thereby reducing the amount of the solvent to be purified of the overall decolorization treatment procedure, so as to reduce the purification energy consumption and the purification cost of the solvent.

After performing a drying treatment on the decolored polyester fabric obtained, the measured CIELAB color definition of the decolored polyester fabric produced in Example 3 had L value of 84, a value of 1.5, and b value of 2.4. The fabric color after decolorization was stable, and the amount of color cast was reduced. The total amount of dye removed was about 99.5 wt %.

Example 4

Propylene glycol monomethyl ether was substituted with xylene, and the rest was the same as Example 1. The measured CIELAB color definition of the decolored polyester fabric had L value of 82, a value of 1.2, and b value of 2.5. The fabric color after decolorization was stable, and the amount of color cast was reduced. The total amount of dye removed was about 99.4 wt %.

Example 5

Propylene glycol monomethyl ether was substituted with xylene, and the rest was the same as Example 3. The measured CIELAB color definition of the decolored polyester fabric had L value of 83, a value of 1.6, and b value of 2.5. The fabric color after decolorization was stable, and the amount of color cast was reduced. The total amount of dye removed was about 99.6 wt %.

Example 6

Propylene glycol monomethyl ether was substituted with dimethylacetamide, and the rest was the same as Example 3. The measured CIELAB color definition of the decolored polyester fabric had L value of 85, a value of 1.4, and b value of 2.3. The fabric color after decolorization was stable, and the amount of color cast was reduced. The total amount of dye removed was about 99.7 wt %.

Comparative Example 1

The main differences between the treatment procedure of Comparative Example 1 and the treatment procedure of Example 1 were that Step S1 and Step S2 were skipped; and Step S3 was repeatedly performed 3 times in Step S4.

Since the second extraction treatment was performed four times in total, in Comparative Example 1, the total amount of the fresh solvent used was up to 24 times the weight of the PET fabric, so the total weight of the propylene glycol monomethyl ether recycled solvent produced was about 24 times the weight of the PET fabric. Since the overall decolorization treatment procedure of Comparative Example 1 did not reuse the recycled solvent, the recycled solvent must be purified by distillation or evaporation to be reused. In other words, the propylene glycol monomethyl ether recycled solvent of Comparative Example 1 was the propylene glycol monomethyl ether solvent to be purified. In this way, the amount of the solvent to be purified of the overall decolorization treatment procedure was greatly increased, causing an increased purification energy consumption and purification cost of the solvent.

After performing a drying treatment on the decolored polyester fabric obtained, the measured CIELAB color definition of the decolored polyester fabric produced in Comparative Example 1 had L value of 87, a value of 2.1, and b value of 6.1. Since the fabric itself contained red and yellow dyes, after continuous use of the fresh solvent for decolorization, the color of the fabric was still reddish (a value was high) and yellowish (b value was high). The total amount of dye removed was about 99.6 wt %.

Comparative Example 2

The main differences between the treatment procedure of Comparative Example 2 and the treatment procedure of Example 2 were that Step S1 and Step S2 were skipped; and Step S3 was repeatedly performed 3 times in Step S4.

Since the second extraction treatment was performed four times in total, in Comparative Example 2, the total amount of the fresh solvent used was up to 24 times the weight of the PET fabric, so the total weight of the propylene glycol monomethyl ether recycled solvent produced was about 24 times the weight of the PET fabric. Since the overall decolorization treatment procedure of Comparative Example 2 did not reuse the recycled solvent, the recycled solvent must be purified by distillation or evaporation to be reused, so the amount of the solvent to be purified of the overall decolorization treatment procedure was greatly increased, causing an increased purification energy consumption and purification cost of the solvent.

After performing a drying treatment on the decolored polyester fabric obtained, the measured CIELAB color definition of the decolored polyester fabric produced in Comparative Example 2 had L value of 88, a value of 3.8, and b value of 6.8. Since the fabric itself contained red and yellow dyes, after continuous use of the fresh solvent for decolorization, the color of the fabric was still reddish (a value was high) and yellowish (b value was high). The total amount of dye removed was about 99.7 wt %.

Comparative Example 3

The main difference between the treatment procedure of Comparative Example 3 and the treatment procedure of Example 3 was that Step S1 and Step S2 were skipped.

Since the second extraction treatment was performed two times in total, in Comparative Example 3, the total amount of the fresh solvent used was about 12 times the weight of the PET fabric, so the total weight of the propylene glycol monomethyl ether recycled solvent produced was about 12 times the weight of the PET fabric. Since the overall decolorization treatment procedure of Comparative Example 3 did not reuse the recycled solvent, the recycled solvent must be purified by distillation or evaporation to be reused, so the amount of the solvent to be purified of the overall decolorization treatment procedure was also increased, causing an increased purification energy consumption and purification cost of the solvent.

After performing a drying treatment on the decolored polyester fabric obtained, the measured CIELAB color definition of the decolored polyester fabric produced in Comparative Example 3 had L value of 75, a value of 3.2, and b value of 6.3. The decolored polyester fabric had noticeable dye residue due to incomplete dye removal, causing incomplete decolorization. The total amount of dye removed was about 98.7 wt %.

Comparative Example 4

Propylene glycol monomethyl ether was substituted with xylene, and the rest was the same as Comparative Example 1. The measured CIELAB color definition of the decolored polyester fabric produced in Comparative Example 4 had L value of 86, a value of 2.3, and b value of 6.4. Since the fabric itself contained red and yellow dyes, after continuous use of the fresh solvent for decolorization, the color of the fabric was still reddish (a value was high) and yellowish (b value was high). The total amount of dye removed was about 99.5 wt %.

Comparative Example 5

Propylene glycol monomethyl ether was substituted with xylene, and the rest was the same as Comparative Example 3. The measured CIELAB color definition of the decolored polyester fabric produced in Comparative Example 5 had L value of 74, a value of 3.5, and b value of 6.4. The decolored polyester fabric had noticeable dye residue due to incomplete dye removal, causing incomplete decolorization. The total amount of dye removed was about 98.4 wt %.

Comparative Example 6

Propylene glycol monomethyl ether was substituted with dimethylacetamide, and the rest was the same as Comparative Example 3. The measured CIELAB color definition of the decolored polyester fabric produced in Comparative Example 6 had L value of 75, a value of 3.1, and b value of 6.0. The decolored polyester fabric had noticeable dye residue due to incomplete dye removal, causing incomplete decolorization. The total amount of dye removed was about 98.8 wt %.

The preparation manners and the test results of Example 1 to Example 6 and Comparative Example 1 to Comparative Example 6 above are summarized in Table 1 below.

TABLE 1

| | Fresh solvent | Solvent/fabric (W/W) | Extraction temperature (° C.) | Extraction time (min) | Extraction pressure (bar) | Treatment procedure | CIELAB L | CIELAB a | CIELAB b | Recycled solvent/fabric (W/W) | Total amount of dye removed (wt %) |
|---|---|---|---|---|---|---|---|---|---|---|---|
| Example 1 | Propylene glycol monomethyl ether | 6/1 | 120 | 30 | 1.0 | S1; S2 (repeat S1 2 times); S3 | 82 | 1.1 | 2.4 | 6 | 99.4 |
| Example 2 | | | 130 | 30 | 1.8 | S1; S2 (repeat S1 1 time); S3; S4 (repeat S3 1 time) | 83 | 1.8 | 2.7 | 12 | 99.6 |
| Example 3 | | | 120 | 30 | 1.0 | S1; S2 (repeat S1 1 time); S3; S4 (repeat S3 1 time) | 84 | 1.5 | 2.4 | 12 | 99.5 |
| Example 4 | Xylene | | 120 | 30 | 1.0 | S1; S2 (repeat S1 2 times); S3 | 82 | 1.2 | 2.5 | 6 | 99.4 |
| Example 5 | Xylene | | 120 | 30 | 1.0 | S1; S2 (repeat S1 1 time); S3; S4 (repeat S3 1 time) | 83 | 1.6 | 2.5 | 12 | 99.6 |
| Example 6 | Dimethylacetamide | | 120 | 30 | 1.0 | S1; S2 (repeat S1 1 time); S3; S4 (repeat S3 1 time) | 85 | 1.4 | 2.3 | 12 | 99.7 |
| Comparative Example 1 | Propylene glycol monomethyl ether | 6/1 | 120 | 30 | 1.0 | S3; S4 (repeat S3 3 times) | 87 | 2.1 | 6.1 | 24 | 99.6 |
| Comparative Example 2 | | | 130 | 30 | 1.8 | S3; S4 (repeat S3 3 times) | 88 | 3.8 | 6.8 | 24 | 99.7 |

TABLE 1-continued

| | Fresh solvent | Solvent/ fabric (W/W) | Extraction temperature (° C.) | Extraction time (min) | Extraction pressure (bar) | Treatment procedure | CIELAB L | a | b | Recycled solvent/ fabric (W/W) | Total amount of dye removed (wt %) |
|---|---|---|---|---|---|---|---|---|---|---|---|
| Comparative Example 3 | | | 120 | 30 | 1.0 | S3; S4 (repeat S3 1 time) | 75 | 3.2 | 6.3 | 12 | 98.7 |
| Comparative Example 4 | Xylene | | 120 | 30 | 1.0 | S3; S4 (repeat S3 3 times) | 86 | 2.3 | 6.4 | 24 | 99.5 |
| Comparative Example 5 | Xylene | | 120 | 30 | 1.0 | S3; S4 (repeat S3 1 time) | 74 | 3.5 | 6.4 | 12 | 98.4 |
| Comparative Example 6 | Dimethylacetamide | | 120 | 30 | 1.0 | S3; S4 (repeat S3 1 time) | 75 | 3.1 | 6.0 | 12 | 98.8 |

Comparing Example 1 with Comparative Example 1, it can be seen that the total number of times of the extraction treatment was both four times. However, since only the fourth extraction treatment of Example 1 used the fresh solvent, the amount of the recycled solvent produced was significantly less than that of Comparative Example 1, and the color cast situation was also better than that of Comparative Example 1. Comparing Example 2 with Comparative Example 2, it can be seen that even at a higher extraction temperature and extraction pressure, Example 2 that used the recycled solvent to perform the first extraction treatment two times could not only reduce the amount of the recycled solvent, but also significantly reduce the color cast phenomenon. In addition, comparing Example 3 with Comparative Example 3, it can be seen that both used the fresh solvent to perform the second extraction treatment two times, so the amounts of the recycled solvent produced were similar. However, since Example 3 also performed the first extraction treatment two times first using the recycled solvent, the color performance was greatly improved compared with Comparative Example 3. In addition, the total amounts of dye removed of Example 1 to Example 3 were similar to the total amounts of dye removed of Comparative Example 1 and Comparative Example 2, indicating that performing the first extraction treatment first using the recycled solvent did not affect the overall dye removal efficiency.

In addition, it can be seen from Example 4 to Example 6 that using xylene or dimethylacetamide as the solvent could also implement stable fabric color after decolorization and reduced color cast. As for Comparative Example 4 to Comparative Example 6, using xylene or dimethylacetamide as the solvent still could not improve the reddish, yellowish, and incomplete decolorization of the fabric after decolorization of Comparative Example 1 or Comparative Example 3.

It can be seen from Table 1 above that Example 1 to Example 6 used the recycled solvent to perform the first extraction treatment of the former Step S1 on the polyester fabric, and only used the fresh solvent in the second extraction treatment of the latter Step S3. Therefore, the amount of the recycled solvent produced and the amount of the solvent to be purified could be significantly reduced. In addition, since the recycled solvent used in the first extraction treatment may be a mixture of recycled solvents produced in the second extraction treatment of multiple batches, the issue of color cast in the decolored polyester fabric produced due to a single color of the dye contained in the recycled solvent can be prevented, so that the CIELAB color definition of the decolored polyester fabric finally obtained may be in the range of L value of above 80, a value of −3.0 to +3.0, and b value of −6.0 to +6.0.

In summary, in the decolorization method of the polyester fabric of the disclosure, performing the first extraction treatment on the polyester fabric using the recycled solvent can lighten the color cast phenomenon in the decolored polyester fabric produced, so as to improve the quality of the decolored polyester fabric recycled. At the same time, the amount of the fresh solvent used, the amount of the recycled solvent produced, and the amount of the solvent to be purified can be greatly reduced, so as to reduce the cost required for performing the decolorization treatment on the polyester fabric.

What is claimed is:

1. A decolorization method of a polyester fabric, comprising:

performing a first extraction treatment on the polyester fabric using a recycled solvent, so that a first portion of a dye in the polyester fabric moves into the recycled solvent;

performing a first filtering treatment on the recycled solvent and the polyester fabric to obtain a treated polyester fabric;

performing a second extraction treatment on the treated polyester fabric using a fresh solvent, so that that a second portion of the dye in the treated polyester fabric moves into the fresh solvent; and performing a second filtering treatment to obtain a decolored polyester fabric and the recycled solvent, wherein the recycled solvent comprises fresh solvent and 0.1 wt. % to 10 wt. % dye, based on a total weight of the recycled solvent.

2. The decolorization method according to claim 1, wherein in the first extraction treatment, a weight ratio of the recycled solvent to the polyester fabric is 4:1 to 50:1.

3. The decolorization method according to claim 1, wherein a weight ratio of the fresh solvent to the treated polyester fabric is 4:1 to 50:1.

4. The decolorization method according to claim 1, wherein the fresh solvent comprises an aromatic hydrocarbon solvent, an alcohol ether solvent, an alcohol solvent, or an amide solvent.

5. The decolorization method according to claim 1, wherein the fresh solvent comprises benzene, toluene, xylene, propylene glycol monomethyl ether, ethylene glycol monobutyl ether, diethylene glycol monobutyl ether, butanol, pentanol, hexanol, dimethylformamide, dimethylacetamide, or a combination thereof.

6. The decolorization method according to claim 1, wherein based on a total weight of the dye, a total amount of the first portion and the second portion removed is 90 wt % to 99.9 wt %.

7. The decolorization method according to claim 1, wherein a CIELAB color definition of the decolored polyester fabric has L value of above 80, a value of −3.0 to +3.0, and b value of −6.0 to +6.0.

8. The decolorization method according to claim 1, further comprising repeatedly performing a cycle of the first extraction treatment and the first filtering treatment 1 to 7 times before the second extraction treatment.

9. The decolorization method according to claim 1, further comprising repeatedly performing a cycle of the second extraction treatment and the second filtering treatment 1 to 3 times after the second filtering treatment.

* * * * *